US006450351B1

(12) United States Patent
Thompson

(10) Patent No.: US 6,450,351 B1
(45) Date of Patent: Sep. 17, 2002

(54) COMPARTMENTED CONTAINER

(76) Inventor: Garey Thompson, 1475 Rosevelte Ave., Springfield, MA (US) 01109

( * ) Notice: Subject to any disclaimer, the term of this patent is extended or adjusted under 35 U.S.C. 154(b) by 0 days.

(21) Appl. No.: 09/933,703

(22) Filed: Aug. 22, 2001

(51) Int. Cl.[7] ..... B65D 25/04
(52) U.S. Cl. ..... 215/6; 220/524
(58) Field of Search ..... 215/6, 232; 220/507, 220/523, 524

(56) References Cited

U.S. PATENT DOCUMENTS 1,462,334 A * 7/1923 Gross ..... 215/6
3,337,073 A * 8/1967 Angelo ..... 215/12.1
3,705,661 A * 12/1972 Davis ..... 215/12.1
5,927,524 A * 7/1999 Miller ..... 206/459.5
6,164,470 A * 12/2000 Chino ..... 215/232

* cited by examiner

*Primary Examiner*—Stephen Castellano
(74) *Attorney, Agent, or Firm*—Barbara R. Greenberg

(57) ABSTRACT

A multi-compartmented container with flexible material simple opening means so that a seal is peeled back from a container compartment opening to allow drinker access to a beverage contained within the container compartment while another container compartment remains sealed.

8 Claims, 4 Drawing Sheets

COMPARTMENTED CONTAINER

FIELD OF THE INVENTION

The present invention relates to a compartmented container and, more particularly, to a compartmented container for simple, sanitary independent dispensing of more than one liquid from one container.

BACKGROUND OF THE INVENTION

At present, carbonated beverages are commonly dispensed in one, two and three liter containers. Once these containers are opened and beverage is withdrawn, the remaining carbonated beverage loses carbon dioxide and simultaneously taste quality deteriorates. Usually the entire beverage is not consumed at one sitting. A first drink of the carbonated liquid can be satisfactory but subsequent drinks can be flat and tasteless. Even if a beverage is not carbonated, taste is compromised once a container is opened. A compartmented container can provide a selection of small quantities of different beverages, each sealed and dispensed separately so freshness is maintained and more than one beverage choice is available in one container.

In addition, compartmented containers provide a means for sanitary beverage drinking. Water bottles are commonly used at sporting events to carry water for thirsty athletes and onlookers. Sometimes, individuals will share a water bottle. A water bottle can become a vector for disease transmission. By providing a compartmented bottle with individual compartments that can accept separate drinking straws, disease organism transmission is minimized. Accordingly, in the present invention, means are provided for individual and selective easy opening of container compartments. When one compartment is opened, another compartment remains closed keeping an enclosed beverage free of harmful organisms. In addition, in the present invention, sanitary means are provided for two or more individuals to drink simultaneously from the same container without the risk of transmitting disease organisms to each other.

Multi-compartmented containers are not unknown. Many such containers exist with a variety of drinking and closing means. U.S. Pat. No. 4,277,000 teaches a multi-compartment container, each compartment having an individual outlet port. The present invention has a single outlet port for all compartments making pouring of a beverage a simple task.

U.S. Pat. No. 5,588,550 teaches a compartmented container, the compartments sealed and opened by rotatable cover alignment. In the present invention, compartments are simply opened by seal removal, usually a foil seal is lifted and peeled back.

U.S. Pat. No. 5,593,052 teaches a two sided baby bottle with stopper insertion means to close one side while the other side remains open for fluid flow through a nipple. Continued use of the stopper causes stopper wear and tear so that eventually the stopper closure may not prevent fluid leakage.

Additional compartmented containers are described in U.S. Pat. Nos. 2,074,414; 5,492,244 and 5,765,725. None of these containers have a simple means for container sealing and pressure retention nor do they have a method for allowing sanitary simultaneous drinking by more than one user.

SUMMARY OF THE INVENTION

A primary object of this invention is to provide a multi-compartmented container with simple opening means to one compartment at a time, each compartment containing a quickly usable amount of beverage.

Another primary object of this invention is to provide a multi-compartmented container, each compartment containing a beverage for simultaneous sanitary use by more than one user.

Still another object of the invention is to provide a multi-compartmented container that keeps one beverage sealed and pressurized while another beverage is consumed.

The foregoing objects and advantages are achieved in one embodiment by having a multi-compartmented container with a neck portion multiple openings, the openings sealed with removable foil seals and secured with a screw type cap, a shoulder portion extending from the neck portion and a body portion extending from the shoulder portion. The shoulder portion with the body portion define side walls that terminate in a body portion bottom wall. An inner surface of the side walls defines a cavity partitioned by a plurality of dividing walls into a plurality of compartments, the walls providing leak proof and pressure tight separation of drinkable liquids.

Sports motifs can be illustrated on the compartmented container front wall. Sports team members can select compartment containers with illustrations depicting the team members' sport. Fewer containers will be needed since more than one team member can use the same container.

The above mentioned objects and features of the invention, along with other novel features that characterize the present invention will become better understood in the following description, appended claims and accompanying drawings in which are illustrated the preferred embodiments of the invention.

DETAILED DESCRIPTION OF THE PREFERRED EMBODIMENTS OF THE INVENTION

Figure 1:
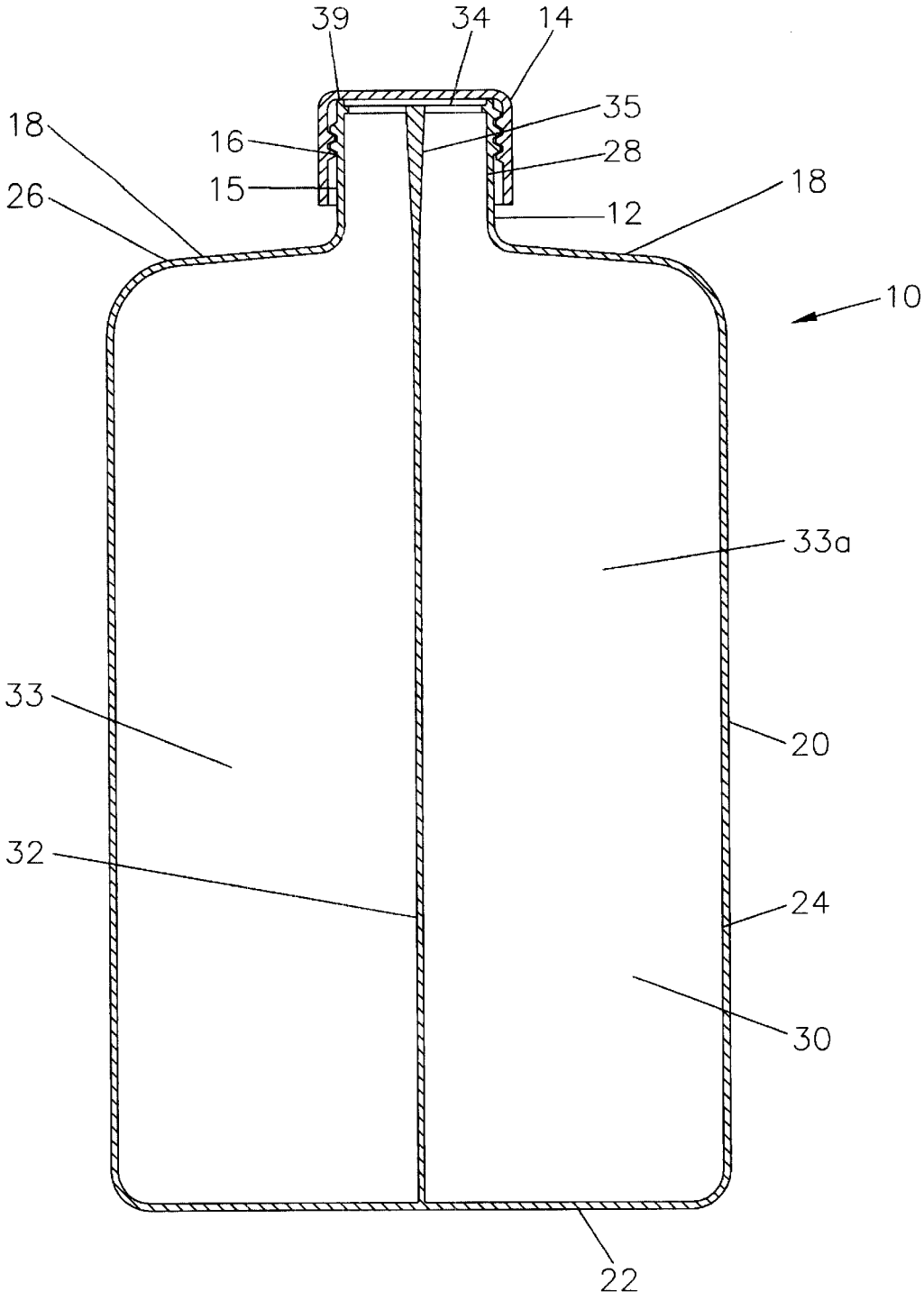
FIG. 1 is a cross sectional elevational view of a compartmented container with a dividing wall in accordance with the principles of the present invention.

Referring now to FIG. 1, and elevational cross section of a compartmented container 10 is shown including a neck portion 12 having means for a cap 14 retention such as outer wall 15 threads 16 to hold the screwed on cap 14. A cap can also be snapped on to neck portion 12. In addition, the compartmented container 10 has a shoulder portion 18 and a body portion 20. The body portion 20 can be cylindrical having a bottom wall 22 contiguous with a side wall 24. Along with the bottom wall 22 and the side wall 24, a shoulder wall 26 and a neck wall 28 define a cavity 30 partitioned by a dividing wall 32 into a plurality of compartments 33, 33*a* for multiple beverage containment. The dividing wall 32 extends substantially in a longitudinal direction of the compartmented container 10 as a vertical extension of bottom wall 22 and is attached or can be molded from side wall 24, shoulder wall 26 and neck wall 28 to terminate at a height equal to the neck wall 28 top surface 34. The dividing wall 32 is thicker at the top surface 34 than at the bottom wall 22. A thickened portion 35 begins gradually as the dividing wall 32 passes through the neck portion 12 reaching a maximum at the top surface 34. This maximum thickness can be an eighth inch wide.

Figure 2:
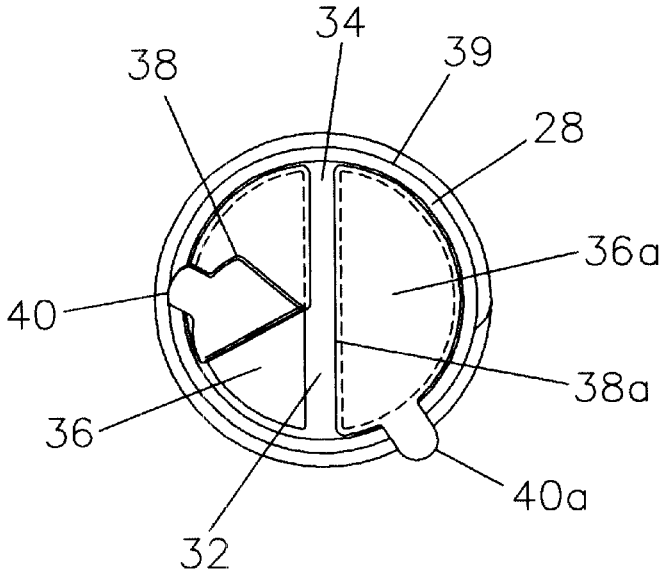
FIG. 2 is a top view of the sealing means for the compartmented container as illustrated in FIG. 1.

FIG. 2 depicts a partially exposed top view of the compartmented container. The dividing wall 32 top surface 34 and neck wall 28 top surface define half moon openings 36, 36*a*, each opening covered by larger than opening seals 38, 38*a*, preferably made of flexible material such as foil seals, the seals 38, 38*a* affixed by an adhesive to the dividing wall 32 top surface 34 and neck wall 28 top surface so that seals 38, 38*a* are adjacent to each other but not touching. Seals 38, 38*a* have tabs 40, 40*a* for easy lifting. A user can disengage and lift seal 38 by pulling tab 40 to expose opening 36 in order to drink a beverage contained in compartmented container 10 compartment 33. A beverage stored in compartment 33*a* will remain sealed, fresh and, if necessary, pressurized until a user removes seal 38*a*. In addition, in order to provide seals 38, 38*a* protection, the perimeter of neck wall 28 is provided with an annular ridge 39.

Figure 3:
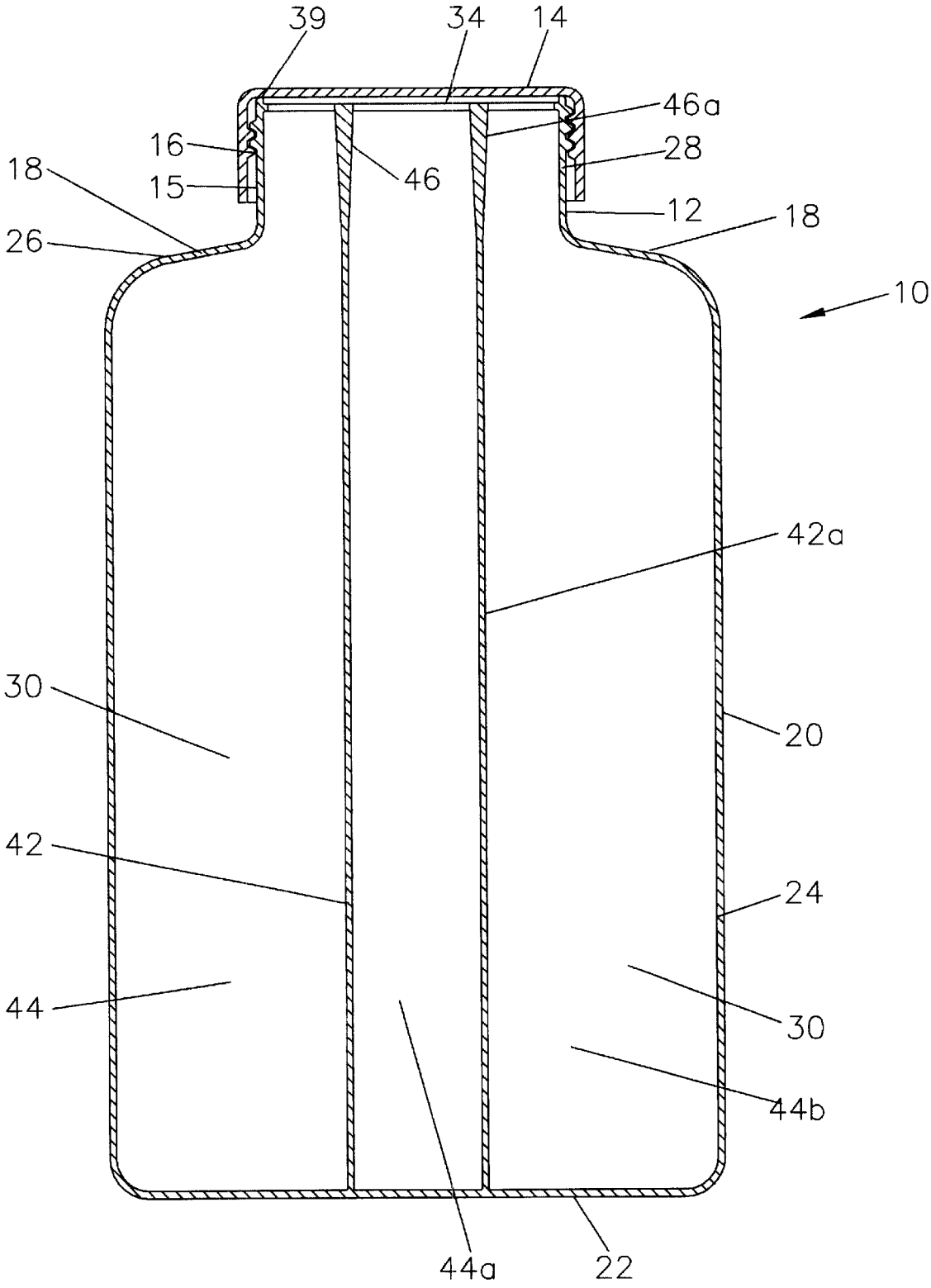
FIG. 3 is a cross sectional elevational view of a compartmented container having a plurality of dividing walls.

In another embodiment, the compartmented container 10 can be fitted with a plurality of dividing walls 42, 42*a* to define compartments 44, 44*a*, 44*b* as depicted in FIG. 3. Dividing walls 42, 42*a* can be extensions of bottom wall 22 and are substantially parallel, extending in a longitudinal direction. Dividing walls 42, 42*a* are attached to or can be molded from side wall 24, shoulder wall 26 and neck wall 28 to terminate at a height equal to the neck wall 28 top surface 34. The dividing walls 42, 42*a* are thicker at the compartmented container 10 neck wall 28 top surface 34 than at the bottom wall 22. Thickened portions 46 and 46*a* begin gradually as the dividing walls 42 and 42*a* pass through the neck portion 12 reaching a maximum width at the top surface 34. This width can be one eighth inch.

Figure 4:
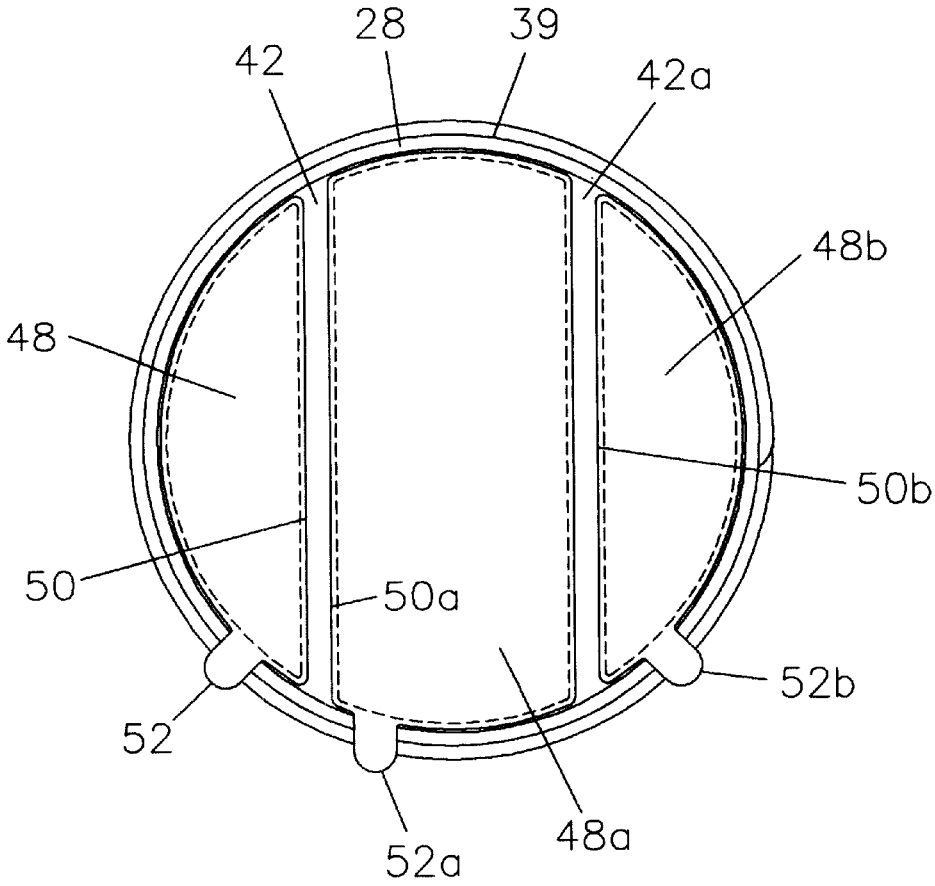
FIG. 4 is a top view of the sealing means for the compartmented container as illustrated in FIG. 3.

FIG. 4 is a partially exposed top view of the compartmented container 10 as illustrated in FIG. 3. Dividing walls 42 and 42*a* with neck wall 28 define openings 48, 48*a* and 48*b*, each opening secured by separate seals 50, 50*a* and 50*b*, respectively. The seals 50, 50*a* and 50*b* have tabs 52, 52*a* and 52*b*, respectively, and the seals 50, 50*a* and 50*b* are affixed to the neck wall 28 top surface 34 and the dividing walls 42, 42*a* top surfaces with an adhesive. The seals 50, 50*a* and 50*b* can be foil seals or can be made of any flexible material that can be easily lifted and peeled away from a surface.

Figure 5:
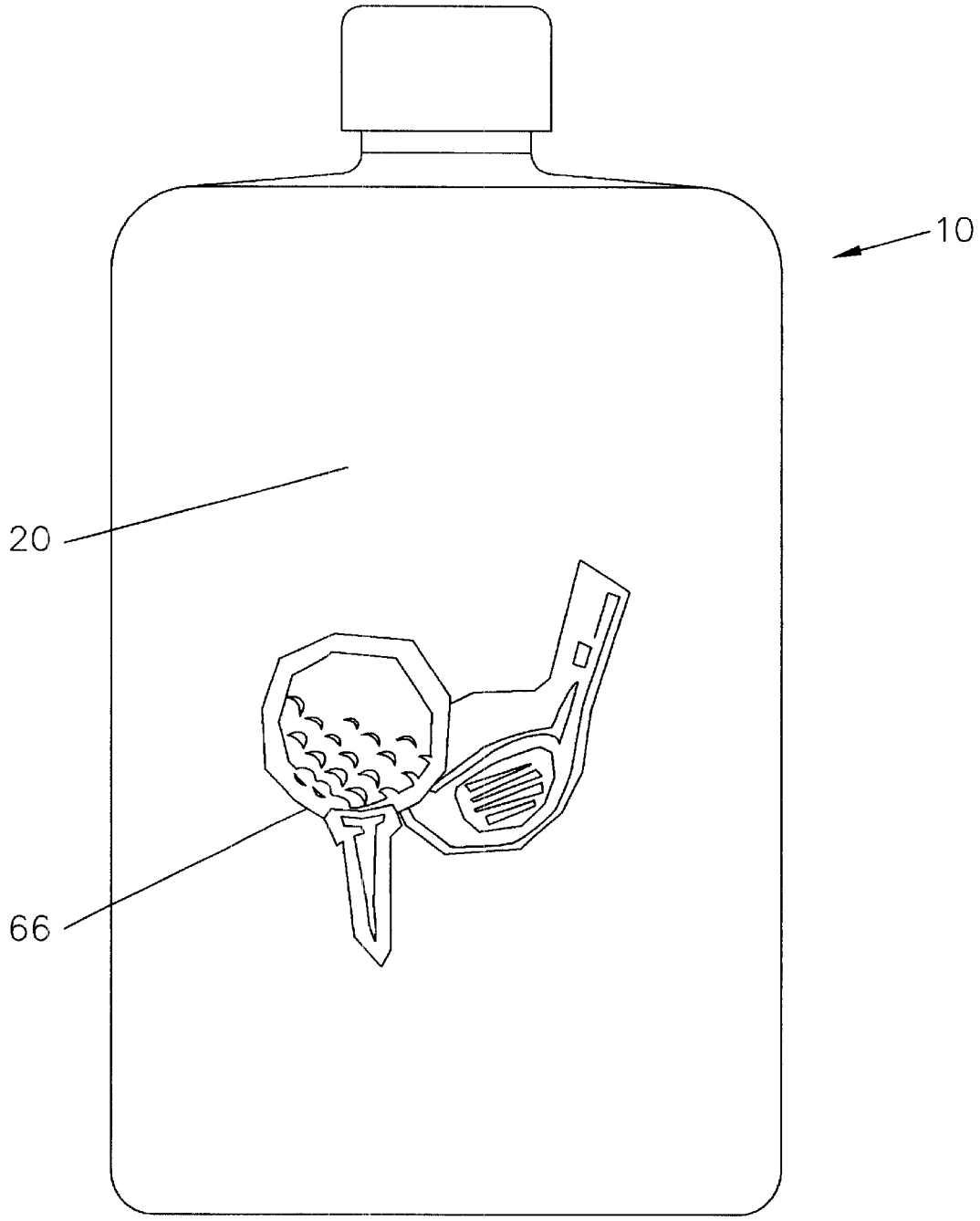
FIG. 5 is a front view of a compartmented container showing a sports graphic on the container front wall surface.

FIG. 5 shows the compartmented container 10 with a body portion 20 sports motif 66 illustration. The sports motif illustration 66 can be a surface illustration or embossed on the body portion 20. The sports motif can be baseball, golf, football, soccer, tennis, volleyball or any other sporting events where participants and onlookers desire to drink liquid beverages. The sports motif 66 can be colored and use symbols to identify a certain sport. In addition, a generic illustration and generic symbols can be placed on the compartmented container 10 body portion 20.

It is to be understood that the present invention is not limited to illustrations and certain embodiments and versions described and shown herein, which are deemed to be merely illustrative of the best and preferred modes of carrying out the invention, and which are susceptible to other versions in regard to arrangement of parts, form, size and mode of operation. Therefore, the present invention is intended to encompass all such versions which are within its spirit and scope as defined by the appended claims.

What is claimed is:

1. A compartmented container comprising:

a neck portion having a neck wall;

a shoulder portion having a shoulder wall; and a body portion having a side wall contiguous with a bottom wall, said neck wall, shoulder wall, side wall and bottom wall defining a cavity, said cavity partitioned by a dividing wall that is an extension of said bottom wall, said dividing wall extending substantially in a longitudinal direction of said compartmented container from said bottom wall to terminate at a top surface of said neck wall, said dividing wall having a thickened portion beginning gradually as said dividing wall passes through said neck portion, reaching a maximum thickness at a dividing wall top surface, so that said neck wall top surface and said dividing wall top surface define semi circular openings, said semi circular openings covered by larger than opening semi circular, flexible, foil, seals affixed to said surfaces, each opening having a separate, spaced, seal and said neck wall top surface having a perimeter annular ring for said seals' protection.

2. The compartment container of claim 1 wherein said body portion exterior surface displays a sports motif illustration.

3. The compartmented container of claim 1 wherein said dividing wall is molded from said side wall.

4. The compartmented container of claim 1 wherein said seals have tab extensions for easy removal.

5. A compartmented container comprising:

a neck portion having a neck wall;

a shoulder portion having a shoulder wall; and a body portion having a side wall contiguous with a bottom wall, said neck wall, shoulder wall, side wall and bottom wall defining a cavity, said cavity partitioned by a plurality of substantially parallel dividing walls that are extensions of said bottom wall, said dividing walls extending substantially in a longitudinal direction of said compartmented container from said bottom wall to terminate at a top surface of said neck wall, said dividing walls having thickened portions beginning gradually as said dividing walls pass through said neck portion, reaching a maximum thickness at said dividing wall top surfaces, said plurality of dividing walls having top surfaces that connect with said neck wall top surface to define a plurality of openings, at least two of said openings being semi circular in shape and at least one opening elongated in shape, said openings covered by a plurality of flexible, foil, larger than opening, spaced seals affixed to said surfaces, at least two of said seals being semi circular in shape and at least one seal elongated in shape, each opening having a separate seal and said neck wall top surface having a perimeter annular ring for said seals' protection.

6. The compartmented container of claim 5 wherein said body portion exterior surface displays a sports motif illustration.

7. The compartmented container of claim 5 wherein said dividing walls are molded from said side wall.

8. The compartmented container of claim 5 wherein said seals have tab extensions for easy removal.

* * * * *